US009775772B2

(12) United States Patent
Tempas et al.

(10) Patent No.: US 9,775,772 B2
(45) Date of Patent: Oct. 3, 2017

(54) WHIRLPOOL BATHTUB AND PURGING SYSTEM

(71) Applicant: Kohler Co., Kohler, WI (US)

(72) Inventors: Jeff Tempas, Oostburg, WI (US); Ravikanth Manchiraju, Peoria, IL (US); Santosh R. Narasimhan, Port Washington, WI (US); Fred Ogreenc, Cedar Grove, WI (US)

(73) Assignee: KOHLER CO., Kohler, WI (US)

( * ) Notice: Subject to any disclaimer, the term of this patent is extended or adjusted under 35 U.S.C. 154(b) by 0 days.

(21) Appl. No.: 15/059,044

(22) Filed: Mar. 2, 2016

(65) Prior Publication Data

US 2016/0256351 A1 Sep. 8, 2016

Related U.S. Application Data

(60) Provisional application No. 62/127,509, filed on Mar. 3, 2015.

(51) Int. Cl.
*A61H 33/02* (2006.01)
*A61H 33/00* (2006.01)

(52) U.S. Cl.
CPC ..... *A61H 33/028* (2013.01); *A61H 33/6026* (2013.01); *A61H 33/6063* (2013.01); *A61H 33/0095* (2013.01); *A61H 33/027* (2013.01); *A61H 2033/002* (2013.01); *A61H 2033/022* (2013.01)

(58) Field of Classification Search
CPC ..... A61H 33/02
USPC ..... 4/538–596
See application file for complete search history.

(56) References Cited

U.S. PATENT DOCUMENTS

| | | | |
|---|---|---|---|
| 3,571,820 | A | 3/1971 | Jacuzzi |
| 3,580,247 | A | 5/1971 | Schneider |
| 3,591,872 | A | 7/1971 | Vanegas et al. |
| 3,736,924 | A | 6/1973 | Jacuzzi et al. |
| 3,742,521 | A | 7/1973 | Bolgert et al. |
| 3,806,964 | A | 4/1974 | Vanegas et al. |
| 3,842,446 | A | 10/1974 | Hunhausen et al. |
| 3,874,374 | A | 4/1975 | Jacuzzi |
| 3,890,656 | A | 6/1975 | Mathis |
| 3,902,529 | A | 9/1975 | Brown |
| 3,961,382 | A | 6/1976 | Peterson, Jr. |
| 3,964,472 | A | 6/1976 | Nicollet |
| 3,986,217 | A | 10/1976 | Doerr et al. |
| 4,004,302 | A | 1/1977 | Hori |
| 4,100,917 | A | 7/1978 | Talge et al. |
| 4,127,117 | A | 11/1978 | Peterson, Jr. |
| 4,166,296 | A | 9/1979 | Darrah et al. |
| 4,211,216 | A | 7/1980 | Burgess et al. |
| 4,218,784 | A | 8/1980 | Richards |
| 4,237,562 | A | 12/1980 | DuPont |

(Continued)

*Primary Examiner* — Lori Baker
(74) *Attorney, Agent, or Firm* — Foley & Lardner LLP

(57) ABSTRACT

A whirlpool bathtub system includes a basin having a plurality of nozzles, a water feed line connected to the plurality of nozzles, an air feed line connected to the plurality of nozzles, a pump configured to circulate water to the basin through the water feed line, and a blower having an off condition and an on condition, the blower being configured to provide air to the basin through the air feed line. When the blower is in the off condition, the blower is configured to allow air to flow into the air feed line. When the blower is in the on condition, the blower is configured to increase the flow of air flowing into the air feed line.

20 Claims, 11 Drawing Sheets

(56) References Cited

U.S. PATENT DOCUMENTS 4,240,166 A 12/1980 Altman et al.
4,249,522 A 2/1981 Carrier
4,304,740 A 12/1981 Cernoch
4,320,541 A 3/1982 Neenan
4,325,149 A 4/1982 Moreland
4,339,833 A 7/1982 Mandell
4,340,039 A 7/1982 Hibbard et al.
4,359,790 A 11/1982 Chalberg
4,402,094 A 9/1983 Sanders
4,419,775 A 12/1983 Ebert
4,420,846 A 12/1983 Bonner
4,510,967 A 4/1985 Spinnett
4,523,340 A 6/1985 Watkins
4,563,781 A 1/1986 James
4,563,782 A 1/1986 Dijkhuizen
4,564,962 A 1/1986 Castleberry et al.
4,586,204 A 5/1986 Daniels
4,592,100 A 6/1986 Robertson et al.
4,602,391 A 7/1986 Shepherd
4,628,908 A 12/1986 Dupont
4,637,080 A 1/1987 Hutchinson
4,672,692 A 6/1987 Savage
4,689,839 A 9/1987 Henkin et al.
4,726,080 A 2/1988 Henkin et al.
4,726,917 A 2/1988 Abe
4,742,584 A 5/1988 Abe
4,761,838 A 8/1988 Hargrove
4,857,112 A 8/1989 Franninge
4,858,255 A 8/1989 Haisman
4,876,752 A 10/1989 Bucher
4,899,401 A 2/1990 Savarese
4,901,379 A 2/1990 Chalberg et al.
4,901,926 A 2/1990 Klotzbach
4,907,305 A 3/1990 Teramachi et al.
4,918,768 A 4/1990 DeSousa et al.
4,924,535 A 5/1990 Yamasaki
4,950,133 A 8/1990 Sargent
4,954,179 A 9/1990 Franninge
4,979,245 A 12/1990 Gandini
4,982,459 A 1/1991 Henkin et al.
4,995,123 A 2/1991 Kern
5,012,535 A 5/1991 Klotzbach
5,031,255 A 7/1991 Hilger et al.
5,032,292 A 7/1991 Conrad
5,038,853 A 8/1991 Callaway, Sr. et al.
5,044,357 A 9/1991 Johns
5,067,481 A 11/1991 Bucher
5,077,841 A 1/1992 Sugai
5,079,784 A 1/1992 Rist et al.
5,083,329 A 1/1992 Murakami
5,092,951 A 3/1992 Popovich et al.
5,144,702 A 9/1992 Haraga et al.
5,153,949 A 10/1992 Karlsson
5,172,432 A 12/1992 Beland
5,195,511 A 3/1993 Kodato et al.
5,197,153 A 3/1993 Hara
5,245,221 A 9/1993 Schmidt et al.
5,245,714 A 9/1993 Haraga et al.
5,267,359 A 12/1993 Clark
5,283,915 A 2/1994 Idland et al.
5,289,598 A 3/1994 Madson, Jr.
5,347,665 A 9/1994 Kumon et al.
5,381,563 A 1/1995 Isabelle et al.
5,383,239 A 1/1995 Mathis et al.
5,386,598 A 2/1995 Mersmann
5,392,473 A 2/1995 Idland et al.
5,404,598 A 4/1995 Hadsell
5,406,654 A 4/1995 Antoine
5,408,708 A 4/1995 Mathis
5,457,826 A 10/1995 Haraga et al.
5,505,847 A 4/1996 Yamada et al.
5,515,557 A 5/1996 Spurlin
5,526,538 A 6/1996 Rainwater
5,604,940 A 2/1997 Shimizu
5,720,905 A 2/1998 Ho
5,752,282 A 5/1998 Silveri
5,809,648 A 9/1998 Kurth et al.
5,822,808 A 10/1998 Esser
5,862,545 A 1/1999 Mathis et al.
5,881,403 A 3/1999 Moreland
5,893,180 A 4/1999 Moreland
5,896,596 A 4/1999 Murakami
5,898,958 A 5/1999 Hall
5,915,849 A 6/1999 Dongo
5,920,923 A 7/1999 Jillette
5,920,925 A 7/1999 Dongo
5,930,852 A 8/1999 Gravatt et al.
5,943,710 A 8/1999 Takagi et al.
5,970,534 A 10/1999 Breda
5,978,982 A 11/1999 Leeuwerik
6,003,167 A 12/1999 Nehring
6,009,574 A 1/2000 Moreland
6,052,844 A 4/2000 Walsh et al.
6,122,775 A 9/2000 Jacuzzi et al.
6,139,512 A 10/2000 Ricchio
6,199,224 B1 3/2001 Versland
6,279,177 B1 8/2001 Gloodt
6,289,530 B1 9/2001 Miller et al.
6,317,903 B1 11/2001 Brunelle et al.
6,357,060 B2 3/2002 Gloodt
6,405,387 B1 6/2002 Barnes
6,406,446 B1 6/2002 Takagi et al.
6,427,257 B1 8/2002 Castellote
6,470,508 B2 10/2002 Turner
6,477,723 B1 11/2002 Jacuzzi et al.
6,477,724 B1 11/2002 Brunelle et al.
6,499,154 B1 12/2002 Niibayashi
6,523,192 B1 2/2003 Gloodt
6,659,112 B1 12/2003 Haupt
6,681,414 B1 1/2004 May et al.
6,723,233 B1 4/2004 Barnes
6,745,413 B2 6/2004 Pinciaro
6,760,932 B1 7/2004 Maiuccoro
6,772,455 B2 8/2004 Takahata et al.
6,859,953 B1 3/2005 Christensen
6,875,961 B1 4/2005 Collins
6,968,581 B2 11/2005 Christensen
6,978,792 B1 12/2005 Strawbridge
7,060,180 B1 6/2006 Barnes
7,076,814 B2 7/2006 Ostrowski et al.
7,182,090 B2 2/2007 Abbott
7,191,998 B1 3/2007 Chalberg et al.
7,334,274 B2 2/2008 Wang
7,503,082 B2 3/2009 Castellote
7,614,095 B2 11/2009 Swart et al.
7,665,158 B2 2/2010 Castellote
7,682,562 B2 3/2010 Ciechanowski et al.
7,802,325 B2 9/2010 Reinhart et al.
7,832,028 B2 11/2010 Yayama et al.
7,875,173 B1 1/2011 Barnes
8,104,110 B2 1/2012 Caudill et al.
8,201,811 B2 6/2012 Cunningham et al.
8,205,277 B2 6/2012 Yamasaki et al.
8,220,082 B2 7/2012 Chen
8,453,275 B2 6/2013 May et al.
8,505,575 B2 8/2013 Chen et al.
8,579,266 B2 11/2013 Cunningham et al.
8,646,759 B2 2/2014 Cunningham et al.
8,720,867 B2 5/2014 Cunningham et al.
8,789,216 B2 7/2014 Sorensen et al.
8,866,336 B2 10/2014 Campbell
8,890,357 B2 11/2014 Campbell
8,931,121 B2 1/2015 Fabian
2003/0233704 A1 12/2003 Castellote
2006/0053546 A1 3/2006 Gloodt
2008/0172783 A1 7/2008 Smith et al.
2010/0287693 A1 11/2010 Gloodt
2011/0252558 A1 10/2011 Ciechanowski et al.
2013/0000031 A1 1/2013 Brunelle et al.

WHIRLPOOL BATHTUB AND PURGING SYSTEM

CROSS-REFERENCE TO RELATED PATENT APPLICATION

This application claims the benefit of and priority to U.S. Provisional Patent Application No. 62/127,509, filed on Mar. 3, 2015, which is hereby incorporated by reference in its entirety.

BACKGROUND

The present invention relates to bathtubs in which air is bubbled into the water, particularly hydro-massage spas and whirlpools. More particularly, it relates to a multipurpose water and air jet system for use with such bathtubs.

Therapeutic water baths and pools are well-known. Spas or whirlpool tubs are common examples in which water streams from jets through the walls of the basin and flows into the water beneath the surface, usually directed at large muscle areas of a person's body, for example, shoulders, back, and thighs. The force from the jets "massage" the bather directly as well as agitate the water to provide therapeutic effects for other parts of the body not directly in the path of the jets.

In a conventional system, the "massage" effect is created by pumping water through a water feed line by a recirculation pump and streaming the water through a number of jet spray nozzles located within the walls of the basin. At the same time, air is drawn into a separate air feed line through an air intake inlet. The air is then drawn from the air line into the water line through a coupled connection to be incorporated into the water as the water streams out of the jets into the basin. In such systems, a bather can typically control the amount of air that is mixed with the water by controlling the opening and closing of the air intake inlet.

However, with this conventional system, the bather is limited by the speed of the pump in the amount and force of air that is fed into the water line as it exits through the jets into the basin. In some instances, the user may desire a "massage" effect that is stronger and more forceful, akin to the effect of a "deep-tissue" massage. In other instances, the user may also desire air that is introduced into the water line in the form of "microbubbles" that cling to the bather's body and rise to the surface of the water slowly and gently, creating a soothing and relaxing effect for the bather.

Moreover, after the bather has finished using this system, the basin is drained of all water. However, in many cases, the system is left with residual water in the water line. This results in stagnant water being left within the system until next use. In some instances, when the bather turns the system back on for a subsequent use, the initial water expelled from the jets may be primarily mixed with this stagnant water, which may not be desirable to the bather.

Accordingly, it would be advantageous to provide a whirlpool bathtub that provides a bather with a multipurpose water and air jet system that allows the bather to increase the "massage" effect by increasing the amount and force of air that is introduced into the water stream. In addition, such a system would also allow the bather to introduce an effervescence effect into the water stream for a soothing and relaxing bubble feel. Finally, the system would further allow the bather to purge the residual water left in the water line, allowing for an improved effect on the quality of the outflow of water when the whirlpool system is turned on for subsequent use. These and other advantageous features of the present invention will become apparent to those reviewing the disclosure and drawings.

SUMMARY

In one embodiment, a whirlpool bathtub system includes a basin having a plurality of nozzles, a water feed line connected to the plurality of nozzles, an air feed line connected to the plurality of nozzles, a pump configured to circulate water to the basin through the water feed line, and a blower having an off condition and an on condition, the blower being configured to provide air to the basin through the air feed line. When the blower is in the off condition, the blower is configured to allow air to flow into the air feed line. When the blower is in the on condition, the blower is configured to increase the flow of air flowing into the air feed line.

In one aspect, the blower is further configured to provide air to the basin through the water feed line.

In one aspect, the whirlpool bathtub system further includes a check valve configured to open and close the flow of air from the blower to the basin through the water feed line.

In one aspect, when the blower is in the off condition, the check valve is closed.

In one aspect, the pump includes an off condition and an on condition. When the blower is in the on condition and the pump is in the off condition, the check valve is open to allow air to flow from the blower to the basin through the water feed line.

In one aspect, the check valve is configured to open and close based on a pressure difference between the water feed line and the air feed line.

In one aspect, the whirlpool bathtub system further includes a Hartford loop in the air feed line.

In one aspect, the whirlpool bathtub system further includes an air intake inlet in the air feed line, the air intake inlet being configured to provide air to the basin through the air feed line to the plurality of nozzles.

In one aspect, the blower comprises a plurality of speed settings being configured to provide air into the air feed line at variable speeds.

In one aspect, the water feed line is configured to distribute water to the plurality of nozzles along a perimeter of the basin.

In one aspect, the air feed line is configured to distribute air to the plurality of nozzles along the perimeter of the basin.

In one aspect, the whirlpool bathtub system further includes a heater configured to heat water flowing through the water feed line.

In one aspect, the blower is connected to the water feed line through a second Hartford loop.

In another embodiment, a purging system for a whirlpool bathtub includes a basin having a plurality of nozzles, a water feed line connected to the plurality of nozzles, and an air feed line connected to the plurality of nozzles. The purging system further includes a pump having an off condition and an on condition and configured to circulate water to the basin through the water feed line, a blower having an off condition and an on condition and configured to provide air to the basin through the air feed line and through the water feed line, and a check valve configured to open and close the flow of air from the blower to the basin through the water feed line. When the pump is in the on condition, the check valve is closed and the blower is configured to provide air to the basin only through the air feed line. When the blower is in the on condition and the pump is in the off condition, the check valve is open and the blower is configured to provide air to the basin through both the air feed line and the water feed line such that residual water present in the water feed line is purged into the basin.

In one aspect, the check valve is configured to open and close based on a pressure difference between the water feed line and the air feed line.

In yet another embodiment, a whirlpool bathtub system includes a basin having a plurality of nozzles, a water feed line connected to the plurality of nozzles, and an air feed line connected to the plurality of nozzles. The whirlpool bathtub system further includes a pump having an off condition and an on condition and configured to circulate water to the basin through the water feed line and a blower having an off condition and an on condition and configured to provide air to the basin through the air feed line. The water feed line includes a suction line configured to allow water to flow from the basin to the pump. The whirlpool bathtub system further includes a conduit connected to the suction line and comprising a bleed hole configured to allow air to flow into the suction line. When the blower is in the off condition, the blower is configured to allow air to flow into the air feed line and, when the blower is in the on condition, the blower is configured to increase the flow of air flowing into the air feed line. When the pump is in the on condition, the conduit is configured to allow air to flow into the pump.

In one aspect, the whirlpool bathtub system further includes a check valve configured to open and close the flow of air from the blower to the basin through the air feed line.

In one aspect, the whirlpool bathtub system further includes a valve configured to open and close the flow of air through the conduit to the suction line.

In one aspect, the bleed hole comprises a diameter ranging from about 0.03 inches to about 0.1 inches.

In one aspect, the conduit extends upward from the suction line such that the bleed hole is at a position above the water feed line.

BRIEF DESCRIPTION OF THE DRAWINGS

FIG. 3B is a schematic view of water and air flow of the jet system of FIG. 3A in a second operating state in which the whirlpool setting is turned on and the blower setting is turned on.

FIG. 3C is a schematic view of water and air flow of the jet system of FIG. 3A in a third operating state in which the whirlpool setting is turned off and the blower setting is turned on.

DETAILED DESCRIPTION

Figure 1:
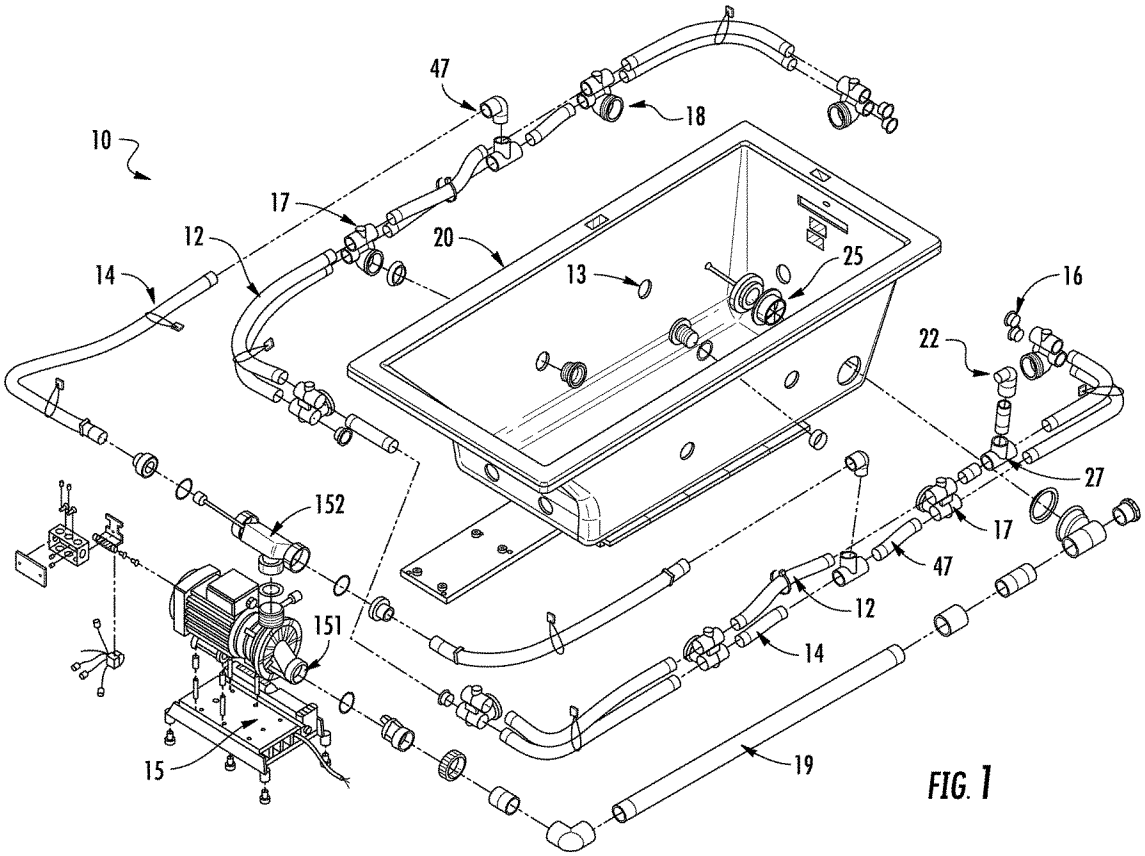
FIG. 1 is an exploded view of a conventional water and air jet system.

Referring to FIG. 1, an exploded view of a water and air jet system 10 of a conventional whirlpool bathtub is shown. The conventional bathtub includes a basin 20 in which water mixed with air is received via numerous entry points 13 directed at various parts of the bather's body. There are two main pipe lines, a water feed line 14 and an air feed line 12. Water is recirculated from the basin 20 through the water line 14 by a recirculation pump 15. The pump may be capable of operating at various speeds, which the bather can set to a desired speed of the water stream. The recirculation pump 15 first pumps water contained in the basin 20 through a suction inlet 25. The water then travels through the suction line 19 and enters the pump 15 at a pump inlet 151. The pump 15 then pumps the water out through a pump outlet 152 via a T-connector that splits the water into two streams that follow the perimeter of the basin 20. On either side of the basin 20, the water flows down into an elbow and T-connector 47, where each stream is further split into two. The water line 14 then flows below the air line 12 along the perimeter of the basin 20, where it is distributed through a number of jet spray nozzles 18 into the basin 20 via entry points 13. The water line 14 ends at opposite ends of the basin 20 where the line is closed via end caps 16.

To entrain the water with air in order to provide the bather with a desired "massage" effect, air is drawn into the air line 12 via an air inlet conduit 22. The air inlet conduit 22 typically includes a valve to open and close the inlet 22 to regulate air flow in the system. When the valve for the inlet 22 is open, air is drawn into the system 10 through inlet 22 where the air flow is then split into two streams via a T-connector 27 to enter the air line 12. The air then follows along the perimeter of the basin passing over a number of coupling connections 17. These connections 17 couple the air line 12 with the water line 14. Via these connections 17, water flowing beneath the air line 12 causes air to be entrained into the flowing water below by a venturi action. The resulting water mixed with air is then sprayed out of the nozzles 18 into the basin 20. The air line 12 ends at one end of the basin 20 where the line is closed via end caps 16.

Figure 2:
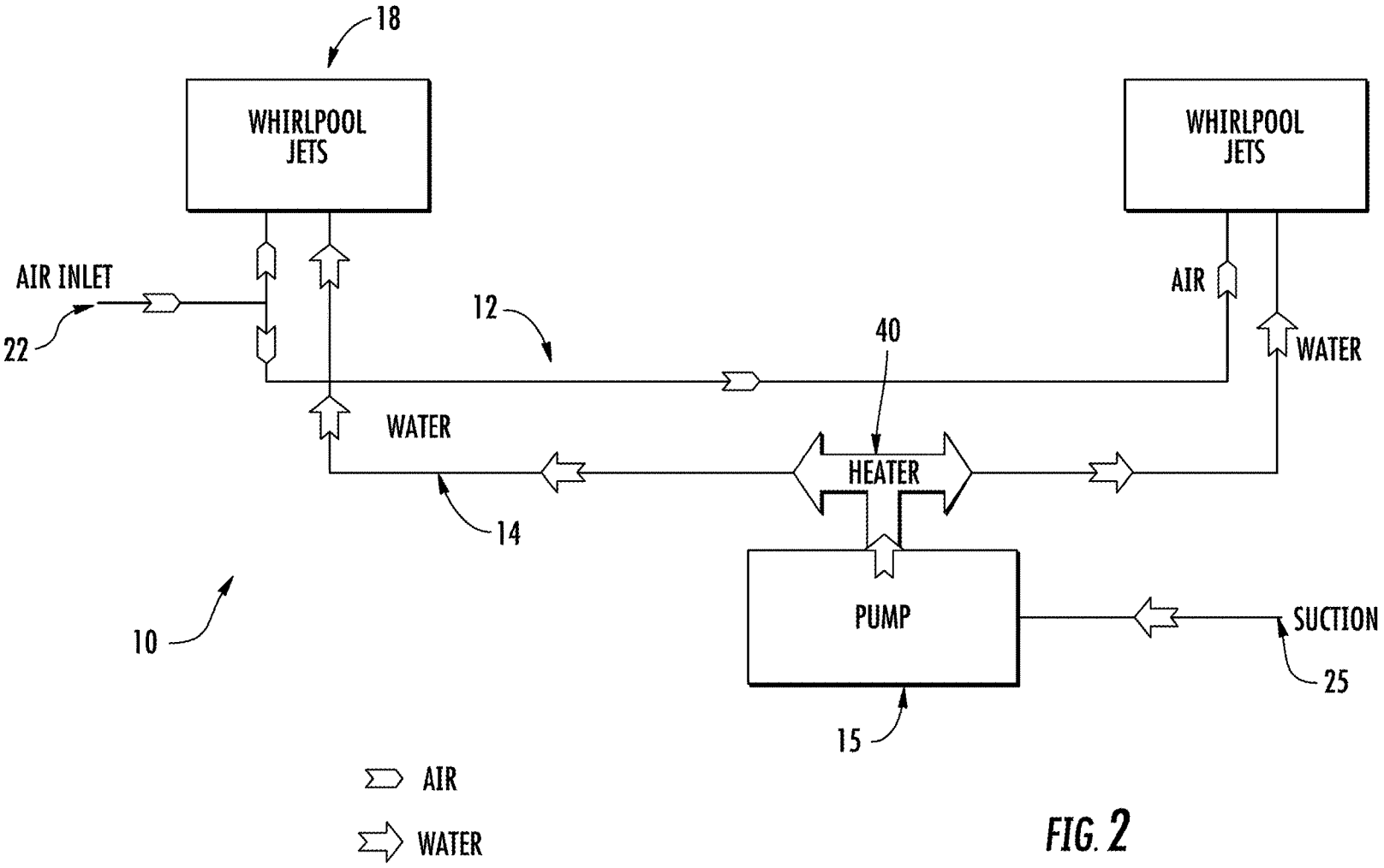
FIG. 2 is a schematic view of water and air flow through the conventional jet system.

A schematic view of the flow of water and air through the water line 14 and air line 12 described in the system 10 of FIG. 1 is shown in FIG. 2. As shown in FIG. 2, the system 10 may also be provided with a heater 40 for warming the recirculated water before it returns to the basin 20. The heater 40 is preferably connected to the recirculation pump 15 and may be controlled by the bather to a desired temperature.

Figure 3A:
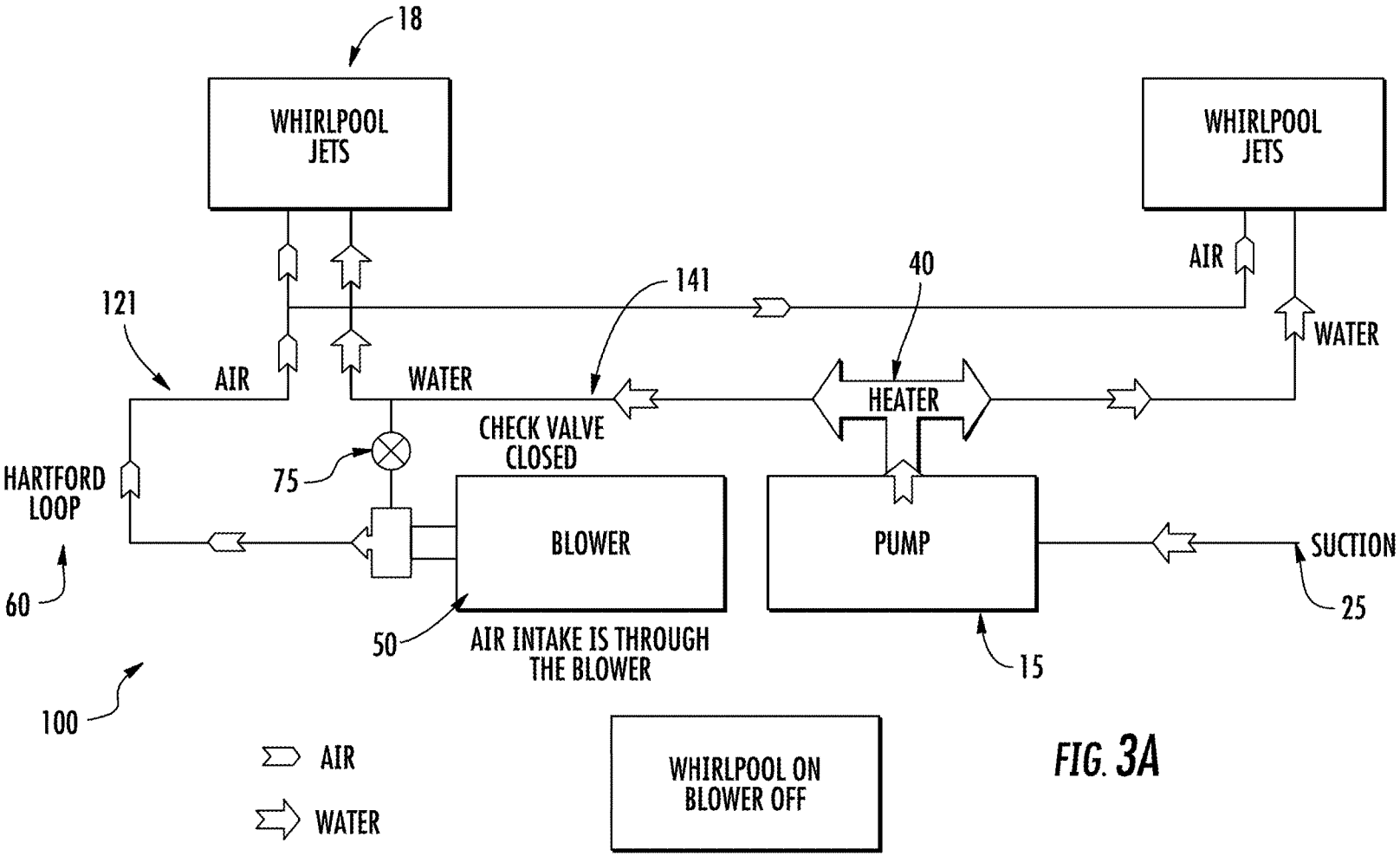
FIG. 3A is a schematic view of water and air flow through a jet system according to an exemplary embodiment in a first operating state in which a whirlpool setting is turned on and a blower setting is turned off.
Figure 3B:
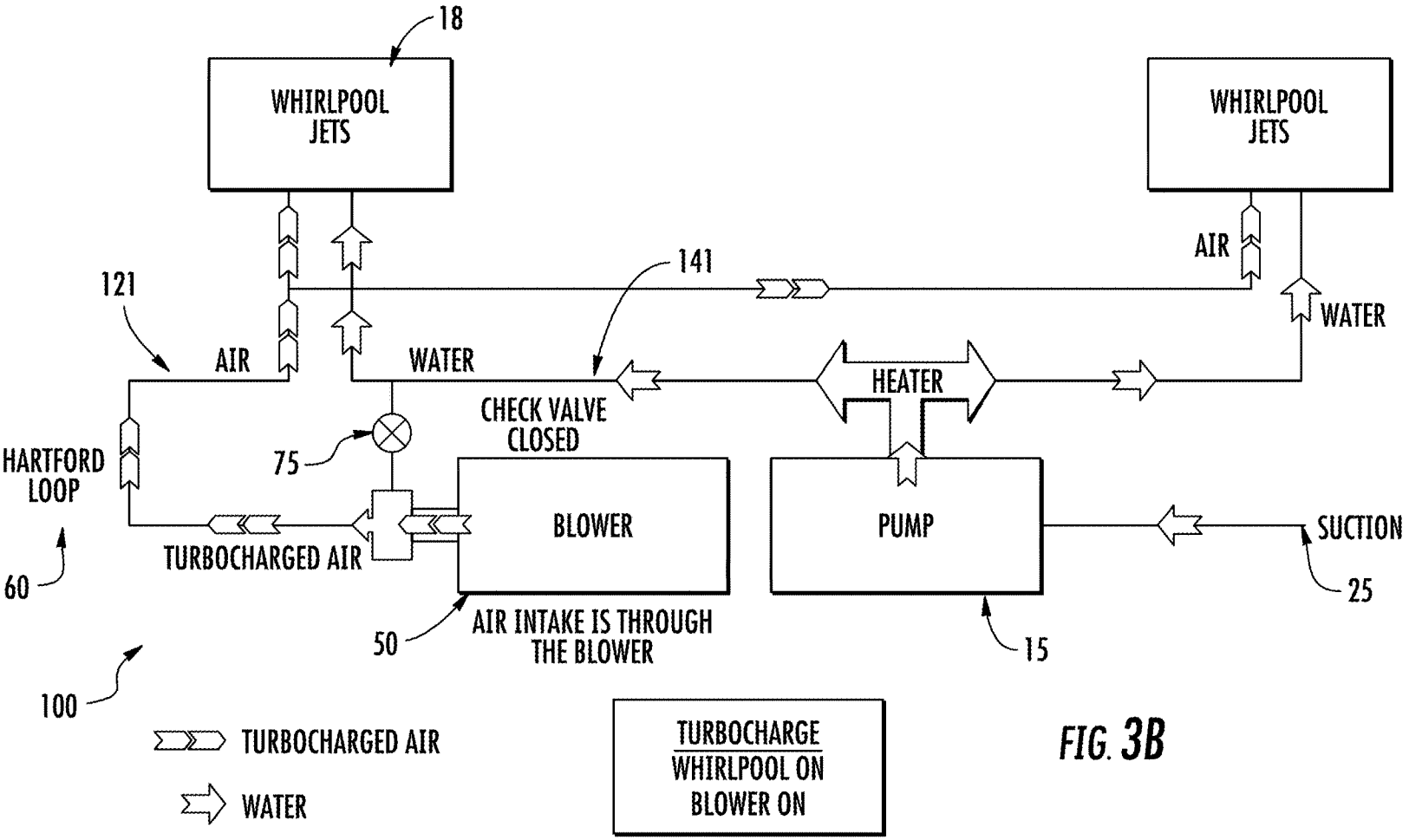
Figure 3C:
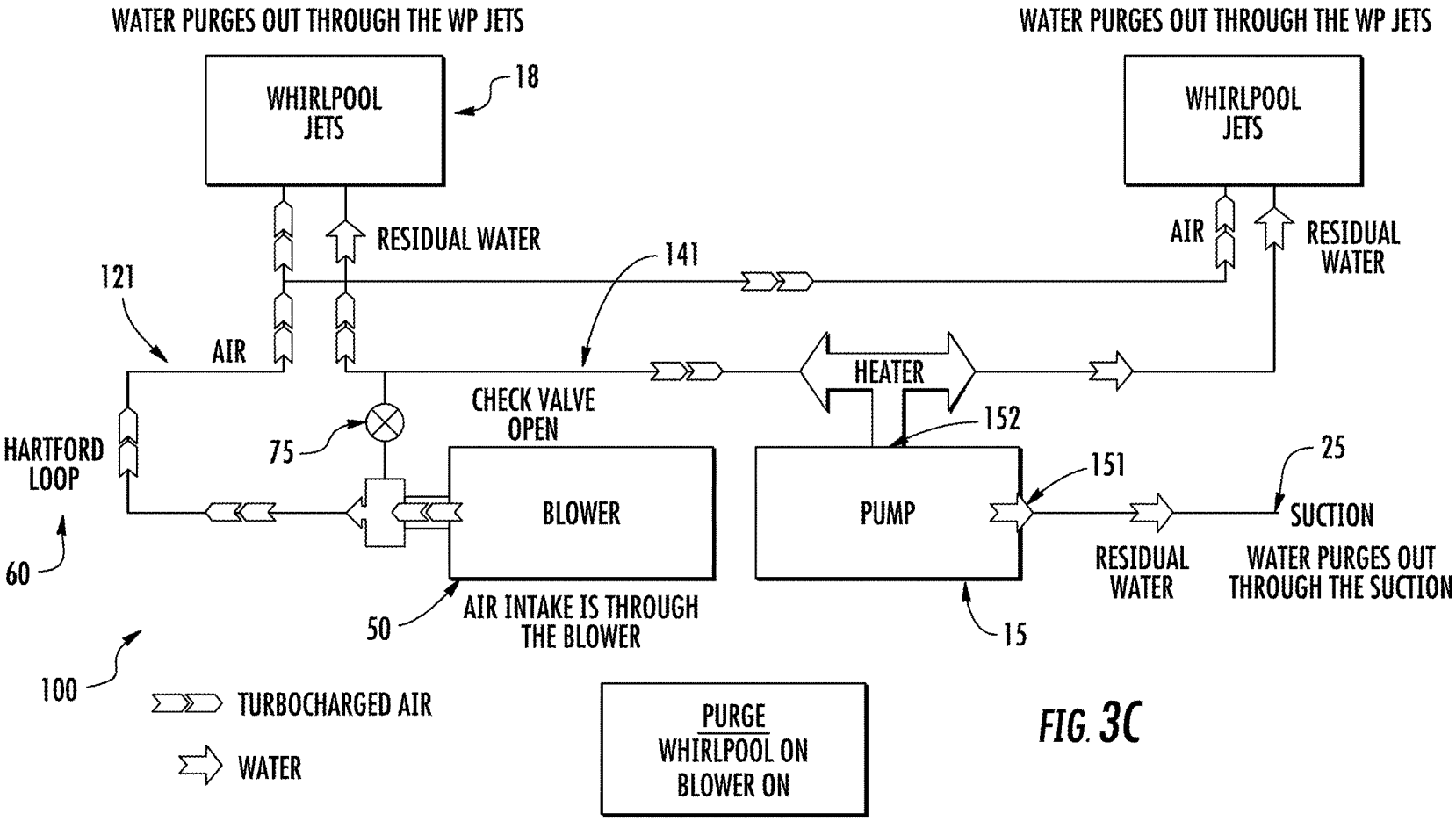

Referring now to FIGS. 3A-3C, schematic views of the flow of water and air in an exemplary embodiment of an improved water and air jet system 100 are shown. Parts and connections that overlap with the conventional system 10 are numbered the same and function in substantially the same way as discussed above with reference to FIG. 1.

As shown in FIG. 3A, as opposed to the conventional system 10 described above, air intake occurs through a blower 50 connected to an air feed line 121. The blower 50 is also connected to a water feed line 141. A check valve 75 is included in the connection to the water feed line 141 to prevent the entrance of water from the water line 141 into the blower 50 when the pump 15 is in operation. In the exemplary embodiment described below, the check valve 75 is controlled to be opened and closed automatically according to pressure differences present in the water line 141 and the blower 50. However, in other exemplary embodiments, the check valve 75 may be operated to be opened and closed via a control system or manual switch. In addition, the connection of the blower 50 to the air line 12 may include a Hartford loop 60 in order to prevent water from entering the blower 50 from the air line 121.

As illustrated in FIG. 3A, a bather can set the system 100 to a first operating state where the blower 50 is turned off and the pump 15 is turned on to create a typical whirlpool effect. In this state, the pressure from the flowing water ensures that the check valve 75 remains closed to prevent water from entering the blower 50. Water is recirculated by the pump 15 through the water line 141 via the suction inlet 25 to the pump inlet 151 of the pump 15. The water is then pumped out of the pump 15 via pump outlet 152 where the water is distributed into the water line 141 and out of the nozzles 18 in the same way described above with reference to FIG. 1.

Figure 8:
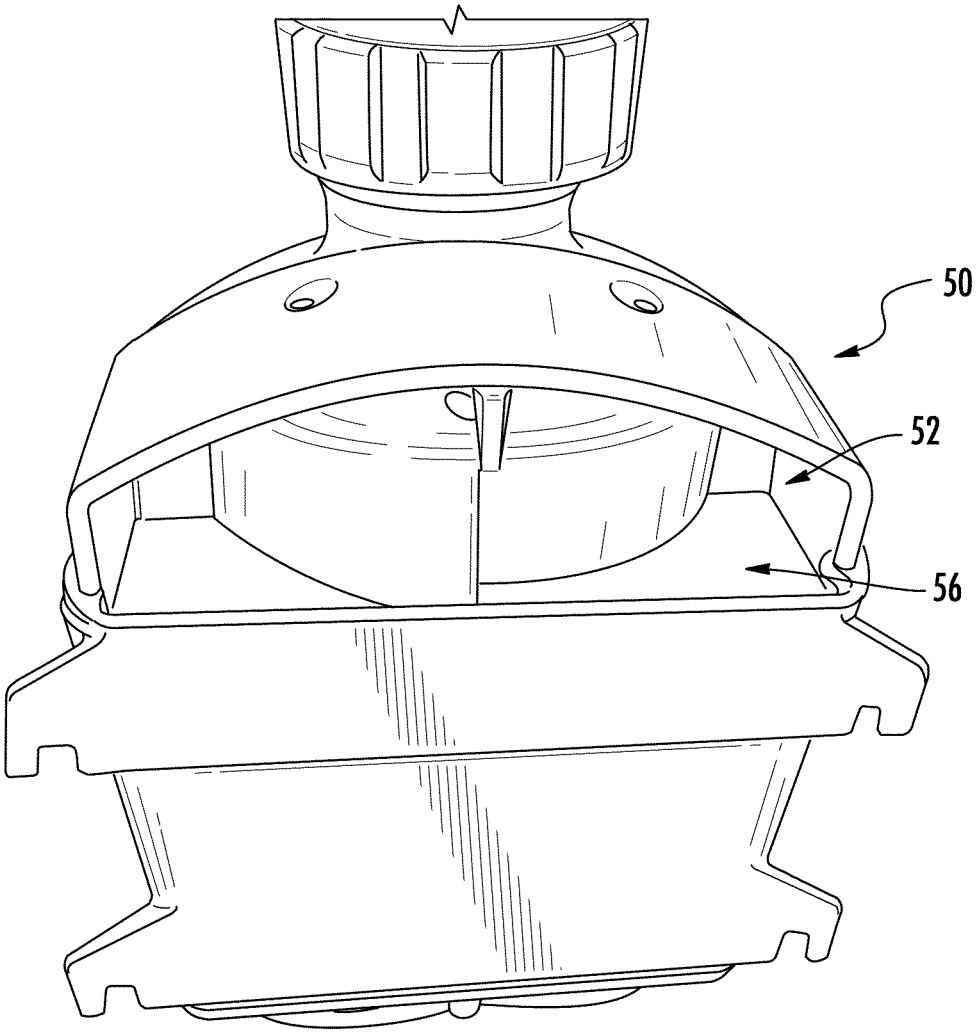
FIG. 8 is a detail view of the blower according to an exemplary embodiment.

As shown in FIG. 8, even though the blower 50 is turned off, the blower 50 remains in communication with ambient air via an opening 52 located on the bottom of the blower 50. The opening 52 allows air to freely flow through the blower 50 and be drawn into the air line 121 in a similar way as that of air intake inlet 22, discussed above. The blower 50 may further include a filter 56 to prevent dirt and other particles from entering the blower 50 and air line 121. After being drawn through the blower 50, the air flows through the Hartford loop 60 into the air line 121 where the air is distributed along the perimeter of the basin 20 over the connections 17. The air is then drawn into the water line 141 via the connections 17, in which it is mixed with the water and exits through nozzles 18 into the basin 20 through entry points 13 as described above with reference to FIG. 1. In other exemplary embodiments, an air intake inlet 22 may added, as described above with reference to FIG. 1, allowing air intake to occur through either the blower 50 or the air intake inlet 22, or both.

To increase the flow and force of air into the water, the bather may choose to turn on the blower 50 to create a "turbocharge" effect, thus allowing the user to feel a greater and more forceful "massage," akin to a "deep tissue" massage. Thus, as schematically illustrated in FIG. 3B, the bather may choose a second operating state in which both the blower 50 and the pump 15 are turned on. In this second operating state, the pressure from the flowing water remains greater than the pressure from the flowing air caused by the blower 50, causing the check valve 75 to remain closed. With the blower 50 turned on, the system 100 operates as normal, except that the amount and force of air is increased by the operation of the blower 50, illustrated as double arrows in FIG. 3B. This "turbocharged" air is forced from the blower 50 through the Hartford loop 60 into the air line 121 via a connector 123, described below with reference to FIG. 4, where the flow is split into two and distributed around the perimeter of the basin 20 over the connections 17. The "turbocharged" air is then drawn into the water line 141 via the connections 17 to be entrained into the flowing water, resulting in a greater whirlpool effect for the bather when the water mixed with air exits through the nozzles 18. Like the pump 15, the blower 50 may also have a number of speed settings, allowing the bather to set a desired speed of the blower 50 for a variable whirlpool effect. In addition, in other exemplary embodiments, the blower 50 may be a pneumatic pump.

After use of the system 100 and after the basin 20 is drained of water, residual water may remain in the water line 141. In order to prevent stagnant water from remaining in the system 100, resulting in an undesirable effect when the system is next used, a third operating state can be set to purge the system 100 of this residual water. The flow of air and the residual water is shown schematically in FIG. 3C. In this state, the blower 50 is turned on, while the pump 15 is turned off. Because the pump 15 is no longer providing water pressure in the water line 141, the pressure from the flowing air caused by the blower 50 is now greater than the pressure present in the water line 141. This causes the check valve 75 to open automatically, allowing flowing air to enter the water line 141. Air is thus forced to flow through the water line 141, in addition to flowing through the air line 121, expelling residual water through the nozzles 18 into the basin 20. Moreover, the air also enters the pump 15 in a reverse direction than the flow of water in normal operation. In other words, air flows into the pump 15 through the pump outlet 152 and flows out of the pump 15 through the pump inlet 151. Air then flows through the suction line 19 and out of the suction inlet 25 to expel any residual water remaining in the suction line 19 into the basin 20, thereby allowing for a complete purge of the entire water line 141 of the system. This third operating state may be automatically set to occur once the bather has finished using the system 100 and the basin 20 has been drained of water. According to another exemplary embodiment, the bather may manually choose to set the operation of the system 100 into the third operating state to purge the system when needed.

Figure 4:
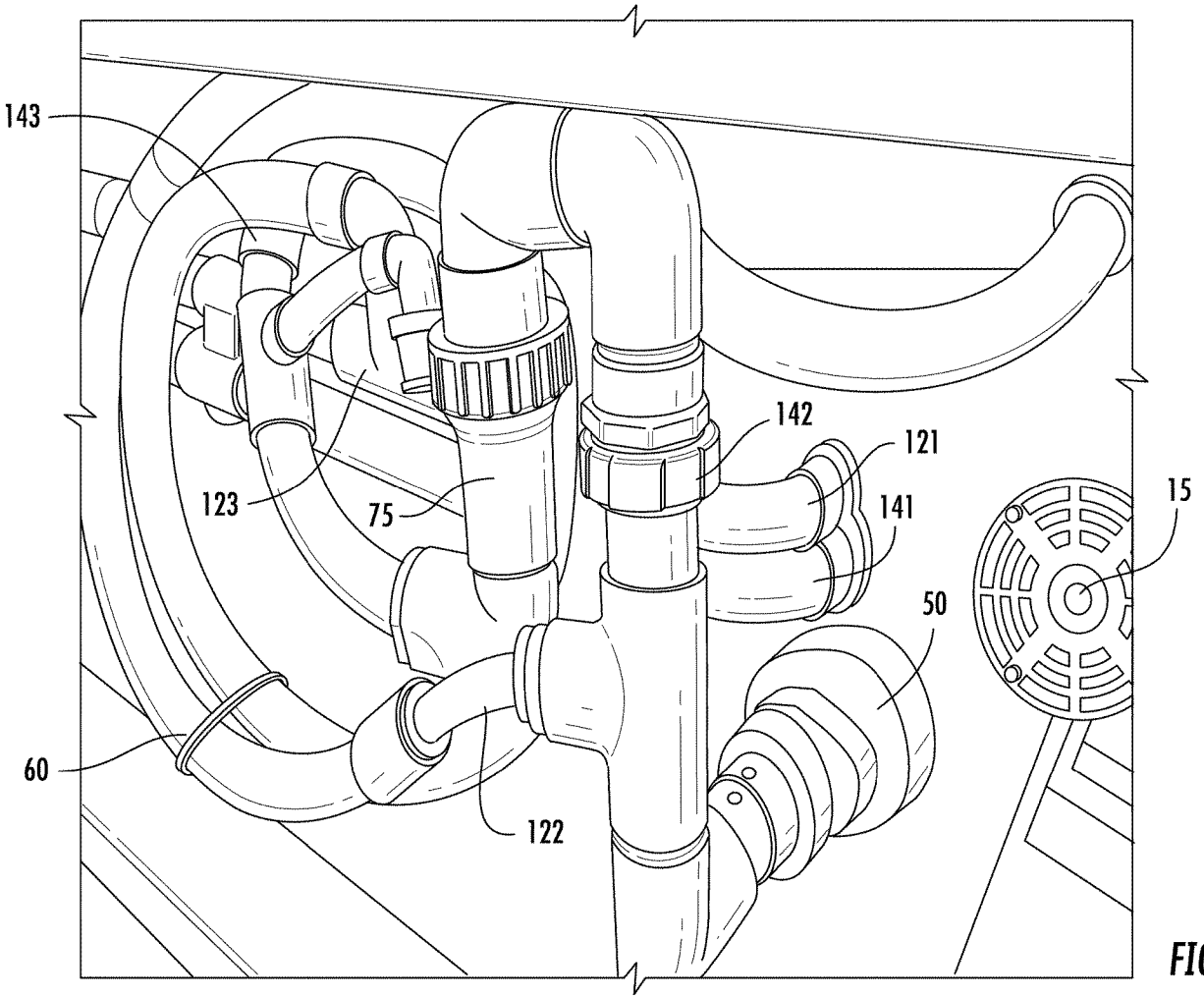
FIG. 4 is a detail view of the check valve and the blower connections to the air line and water line according to an exemplary embodiment.
Figure 5:
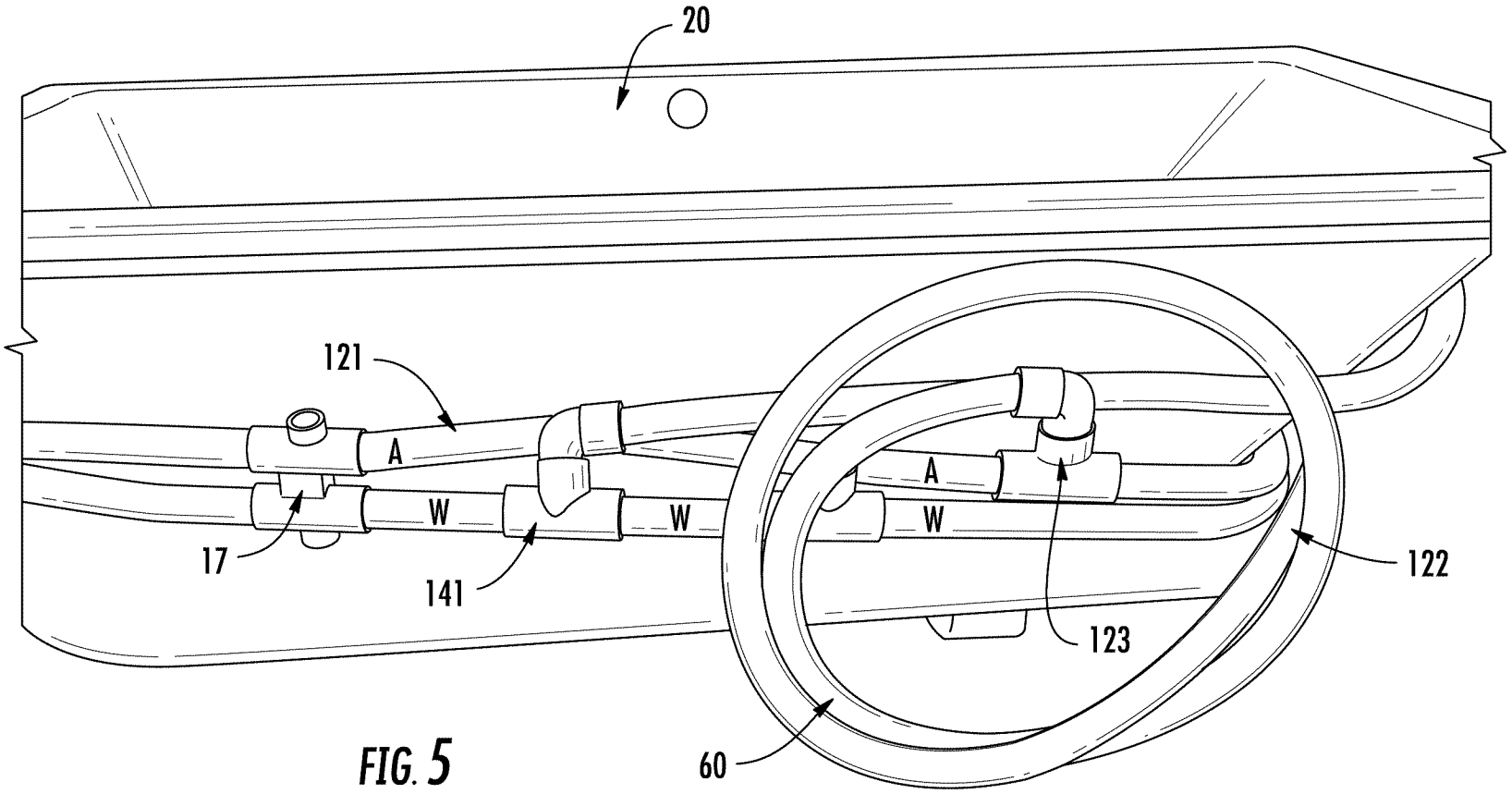
FIG. 5 is a detail view of an arrangement of the blower connection to the air line according to another exemplary embodiment.
Figure 6:
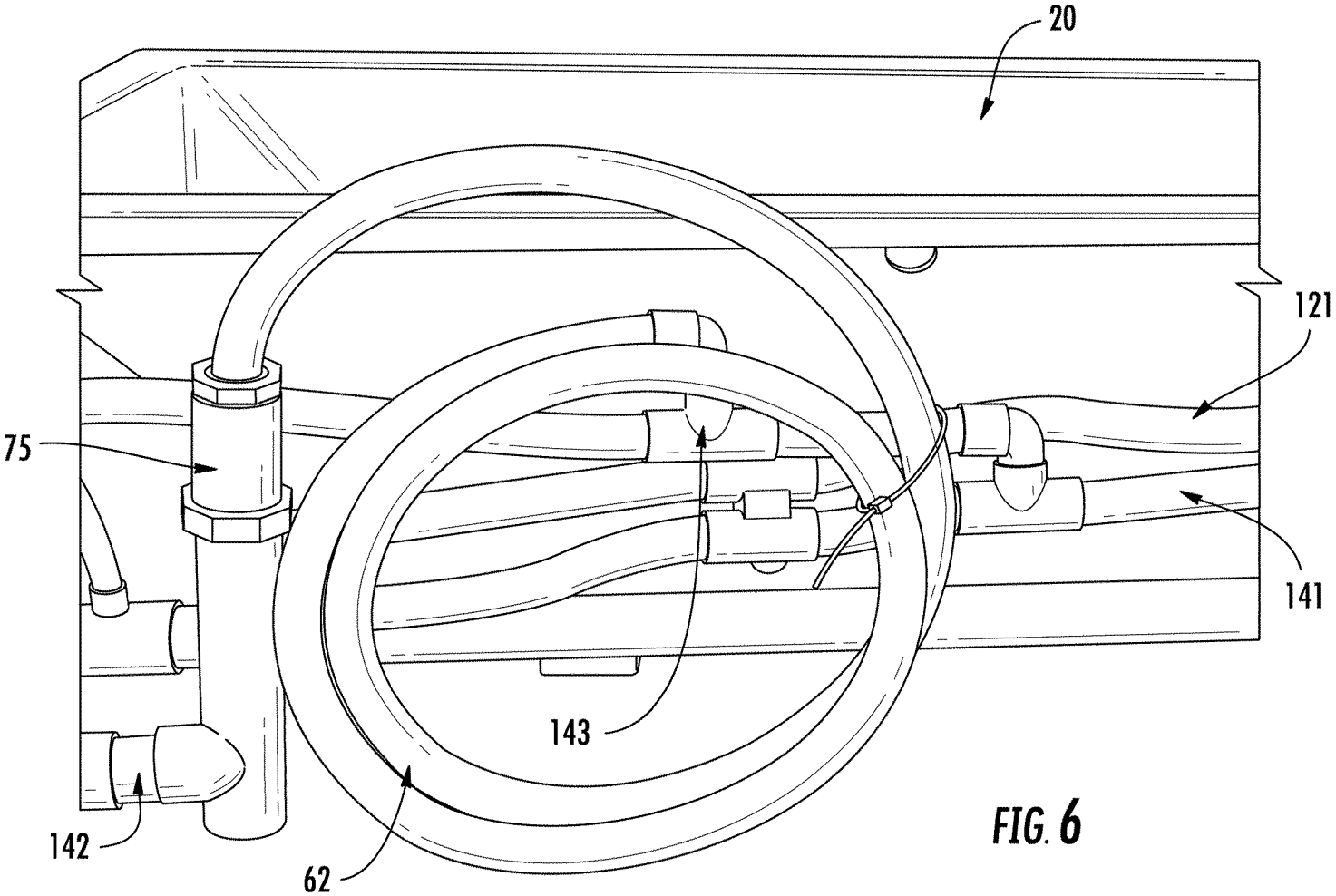
FIG. 6 is a detail view of an arrangement of the blower connection to the water line according to another exemplary embodiment.

FIG. 4 illustrates a detail view of a preferable arrangement of the blower 50 and its connection to the air line 121 and water line 141 according to an exemplary embodiment. As shown in FIG. 4, the feed from the blower 50 splits off into two passageways. The first passageway 142 leads to a U-shaped connection that includes the check valve 75. Upstream from the check valve 75, the passageway 142 continues to connect the blower 50 to the water line 141 via a connector 143. On the other hand, the second passageway 122 follows the Hartford loop 60 which ends to connect the blower 50 to the air line 121 via a connector 123. In another exemplary embodiment, as illustrated in FIG. 5, the blower 50 (not shown) may connect to the air line 121 on a different side of the basin 20 from the connection to the water line 141 (not shown) via a longer second passageway 122. The second passageway 122 allows air to flow into the Hartford loop 60, which connects the blower 50 to the air feed 121 via the connector 123. Moreover, in yet another exemplary embodiment, as illustrated in FIG. 6, the blower 50 may be connected to the water line 141 via the addition of a second Hartford loop 62 for an added safety mechanism to prevent the flow of water into the blower 50. In this arrangement, air flows from the blower 50 via first passageway 142, up through check valve 75, which then feeds into the second Hartford loop 62. The second Hartford loop 62 ends to connect the blower 50 to the water feed 141 via connection 143.

Figure 7A:
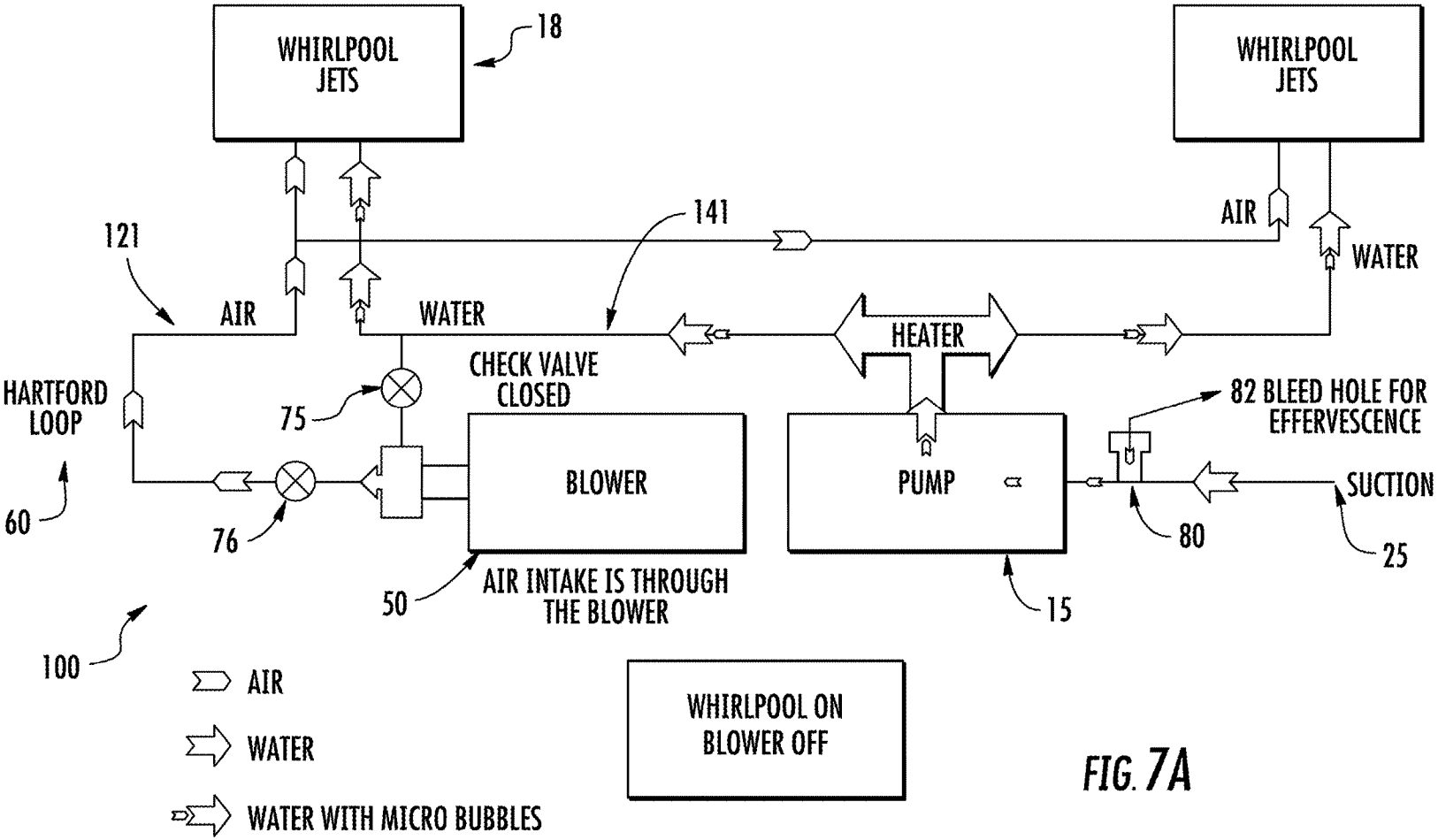
FIG. 7A is a schematic view of an arrangement of the water and air flow of a jet system according to another exemplary embodiment in which an effervescence conduit is introduced.
Figure 7B:
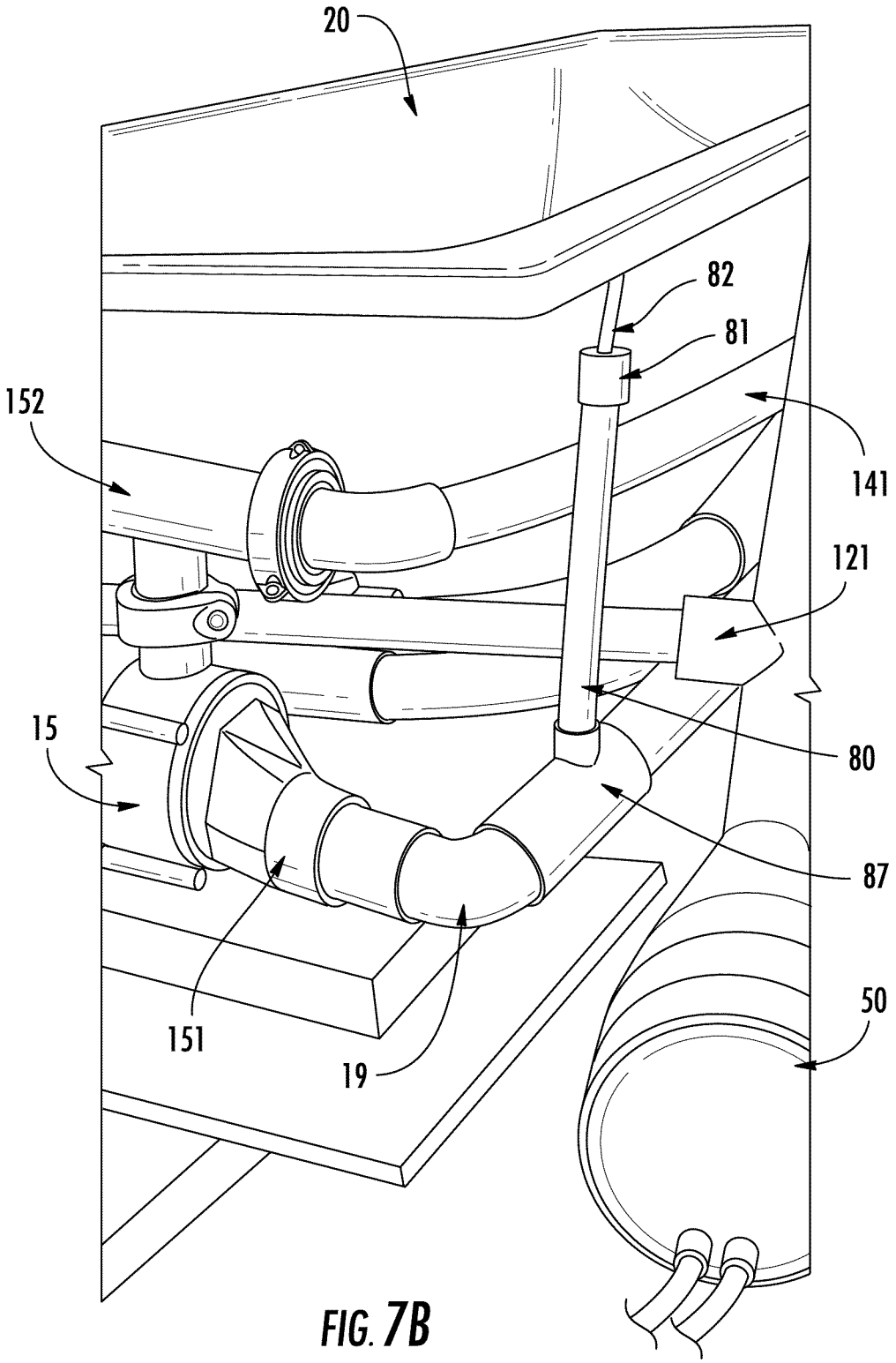
FIG. 7B is a detail view of the effervescence conduit illustrated in FIG. 7A.

In order to provide a more "soothing" bubble effect, the system 100 may also provide the bather with the option of adding effervescence to the water flow as schematically shown in FIG. 7A. As detailed in FIG. 7B, in this arrangement, a conduit 80 may be connected via a T-connector 87 to the suction line 19 of the pump 15. The top end of the conduit 80 is covered by a cap 81 having a very small bleed hole 82. The small bleed hole 82 allows air to be drawn into the conduit 80 in the form of "microbubbles" due to the pressure difference created by the flowing water in the suction line 19. The bubbles intentionally cavitate the pump 15, where the bubbles are made even smaller and dispersed by the pump 15 before flowing into the water line 141 and entering the basin 20. Once in the basin 20, this micro-effervescence clings to the bather's body and rises to the surface slowly and gently, creating a soothing and relaxing effect for the bather. The bather may choose to turn off this effervescence effect by closing the conduit 80 with the use of a valve, such as an electronic valve. According to one exemplary embodiment, the blower connection to the air line 121 is configured with a valve 76, as illustrated in FIG. 7A. Thus, when the bather desires the effervescence effect without experiencing the whirlpool effect caused by air intake occurring through the blower 50, the air line 121 can be closed by closing the valve 76.

According to an exemplary embodiment, the conduit 80 extends upward above the water line 141 in order to prevent water leakage into the bleed hole 82. In yet another exemplary embodiment, a valve may be used to prevent water from entering the bleed hole 82. In addition, for an optimal effervescence effect, the bubble size expelled into the basin 20 may range from about 0.03 inches to about 0.1 inches in diameter. To accomplish a desirable bubble size, the size of the bleed hole 82 needed will depend on the basin size. However, the bleed hole 82 will preferably range in size from about 0.015 inches to about 0.09 inches in diameter.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that the term "exemplary" as used herein to describe various embodiments is intended to indicate that such embodiments are possible examples, representations, and/or illustrations of possible embodiments (and such term is not intended to connote that such embodiments are necessarily extraordinary or superlative examples).

The terms "coupled," "connected," and the like as used herein mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

It is important to note that the construction and arrangement of the various exemplary embodiments are illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter described herein. For example, elements shown as integrally formed may be constructed of multiple parts or elements, the position of elements may be reversed or otherwise varied, and the nature or number of discrete elements or positions may be altered or varied. The order or sequence of any process or method steps may be varied or re-sequenced according to alternative embodiments. Other substitutions, modifications, changes and omissions may also be made in the design, operating conditions and arrangement of the various exemplary embodiments without departing from the scope of the present invention.

What is claimed is:

1. A whirlpool bathtub system comprising:

a basin having a plurality of nozzles;

a water feed line connected to the plurality of nozzles;

an air feed line connected to the plurality of nozzles;

a pump configured to circulate water to the basin through the water feed line; and a blower having an off condition and an on condition, the blower being configured to provide air to the basin through the air feed line;

wherein, when the blower is in the off condition, the blower is configured to allow air to flow into the air feed line, and when the blower is in the on condition, the blower is configured to increase the flow of air flowing into the air feed line.

2. The whirlpool bathtub system of claim 1, wherein the blower is further configured to provide air to the basin through the water feed line.

3. The whirlpool bathtub system of claim 2, further comprising a check valve configured to open and close the flow of air from the blower to the basin through the water feed line.

4. The whirlpool bathtub system of claim 3, wherein, when the blower is in the off condition, the check valve is closed.

5. The whirlpool bathtub system of claim 3, wherein the pump includes an off condition and an on condition and, when the blower is in the on condition and the pump is in the off condition, the check valve is open to allow air to flow from the blower to the basin through the water feed line.

6. The whirlpool bathtub system of claim 3, wherein the check valve is configured to open and close based on a pressure difference between the water feed line and the air feed line.

7. The whirlpool bathtub system of claim 1, further comprising a Hartford loop in the air feed line.

8. The whirlpool bathtub system of claim 1, further comprising an air intake inlet in the air feed line, the air intake inlet configured to provide air to the basin through the air feed line to the plurality of nozzles.

9. The whirlpool bathtub system of claim 1, wherein the blower comprises a plurality of speed settings that are configured to provide air into the air feed line at variable speeds.

10. The whirlpool bathtub system of claim 1, wherein the water feed line is configured to distribute water to the plurality of nozzles along a perimeter of the basin.

11. The whirlpool bathtub system of claim 9, wherein the air feed line is configured to distribute air to the plurality of nozzles along the perimeter of the basin.

12. The whirlpool bathtub system of claim 1, further comprising a heater configured to heat water flowing through the water feed line.

13. The whirlpool bathtub system of claim 1, wherein the blower is connected to the water feed line through a second Hartford loop.

14. A system for a whirlpool bathtub comprising:

a basin having a plurality of nozzles;

a water feed line connected to the plurality of nozzles;

an air feed line connected to the plurality of nozzles;

a pump having an off condition and an on condition, the pump being configured to circulate water to the basin through the water feed line;

a blower having an off condition and an on condition, the blower being configured to provide air to the basin through the air feed line and through the water feed line; and a check valve configured to open and close the flow of air from the blower to the basin through the water feed line;

wherein, when the pump is in the on condition, the check valve is closed and the blower is configured to provide air to the basin only through the air feed line and, when the blower is in the on condition and the pump is in the off condition, the check valve is open and the blower is configured to provide air to the basin through both the air feed line and the water feed line such that residual water present in the water feed line is purged into the basin.

15. The system of claim 14, wherein the check valve is configured to open and close based on a pressure difference between the water feed line and the air feed line.

16. A whirlpool bathtub system comprising:

a basin having a plurality of nozzles;

a water feed line connected to the plurality of nozzles;

an air feed line connected to the plurality of nozzles;

a pump having an off condition and an on condition, the pump being configured to circulate water to the basin through the water feed line, wherein the water feed line comprises a suction line configured to allow water to flow from the basin to the pump;

a blower having an off condition and an on condition, the blower being configured to provide air to the basin through the air feed line;

a conduit connected to the suction line, the conduit comprising a bleed hole configured to allow air to flow into the suction line;

wherein, when the blower is in the off condition, the blower is configured to allow air to flow into the air feed line and, when the blower is in the on condition, the blower is configured to increase the flow of air flowing into the air feed line; and wherein, when the pump is in the on condition, the conduit is configured to allow air to flow into the pump.

17. The whirlpool bathtub system of claim 16, further comprising a check valve configured to open and close the flow of air from the blower to the basin through the air feed line.

18. The whirlpool bathtub system of claim 16, further comprising a valve configured to open and close the flow of air through the conduit to the suction line.

19. The whirlpool bathtub system of claim 16, wherein the bleed hole comprises a diameter ranging from about 0.03 inches to about 0.1 inches.

20. The whirlpool bathtub system of claim 16, wherein the conduit extends upward from the suction line such that the bleed hole is at a position above the water feed line.

* * * * *